US005904587A

United States Patent [19]

Osypka et al.

[11] Patent Number: 5,904,587

[45] Date of Patent: May 18, 1999

[54] CONNECTOR WITH A PLUG AND A SOCKET

[75] Inventors: Peter Osypka, Grenzach-Wyhlen; Wolfgang Geistert, Rheinfelden, both of Germany

[73] Assignee: Sulzer Osypka GmbH, Grenzach-Wyhlen, Germany

[21] Appl. No.: 08/930,722

[22] PCT Filed: Apr. 17, 1996

[86] PCT No.: PCT/EP96/01602

§ 371 Date: Oct. 2, 1997

§ 102(e) Date: Oct. 2, 1997

[87] PCT Pub. No.: WO96/35245

PCT Pub. Date: Nov. 7, 1996

[30] Foreign Application Priority Data

Apr. 29, 1995 [DE] Germany ..... 195 15 822

[51] Int. Cl.[6] ..... H01R 17/04

[52] U.S. Cl. ..... 439/263; 439/584

[58] Field of Search ..... 439/263, 725, 439/727, 825, 584, 127, 122, 252, 259

[56] References Cited

U.S. PATENT DOCUMENTS

| | | | |
|---|---|---|---|
| 3,094,365 | 6/1963 | Chamberlain et al. | 439/263 |
| 3,824,556 | 7/1974 | Berkovits et al. | 439/727 |
| 3,854,789 | 12/1974 | Kaplan | 439/584 |
| 4,156,554 | 5/1979 | Aujla | 439/584 |
| 4,952,174 | 8/1990 | Sucht et al. | 439/584 |
| 5,188,537 | 2/1993 | Itoh et al. | 439/127 |

FOREIGN PATENT DOCUMENTS 1738657 1/1957 Germany .

*Primary Examiner*—Steven L. Stephan
*Assistant Examiner*—Michael C. Zarroli
*Attorney, Agent, or Firm*—Panitch Schwarze Jacobs & Nadel, P.C.

[57] ABSTRACT

The electrical connector (1) with a socket section (2) and a plug section (3) contains a clip (4) by which the pin (5) of the plug section (3) can be clamped in the axial direction and secured against unintentional withdrawal. In addition there is protection against contact with the live parts of the connector (1) which nevertheless permits the rotation of the clip (4) so that it can be closed and opened. Essentially, the plug section (2) has a sleeve (13) which surrounds the pin (5) externally and in spaced relationship to it and is rotatable in relation to the plug section (2), which sleeve (13) is of such an axial length and inner dimensions that, with the pin (5) inserted into the clip (4), the sleeve (13) is axially movably pushed in an axial direction onto the component serving to rotate the conical section (6) of the clip (4) and at the same time is coupled thereto in the direction of rotation. Rotating the sleeve (13) when the electrical connector is assembled can thus close the clip and contra-rotating it opens said clip, the conical section (6) then moving axially in relation to the sleeve but being also driven in the direction of rotation. At the same time, the sleeve (13) protects the pin (5) against undesired contact even when the connector (1) is disassembled.

13 Claims, 3 Drawing Sheets

CONNECTOR WITH A PLUG AND A SOCKET

BACKGROUND OF THE INVENTION

The invention relates to an electrical connector with a plug and a socket, whereby the socket has a clamping device for fixing a pin of the plug, the clamping device consisting of a clip and a conical section form-lockingly interconnected by means of a threaded joint and the fixation of the plug pin in the clamping device being constituted by the relative movement of clip and conical section to each other by means of the threaded joint.

A connector of such a character is known from German Utility Model No. 1 738 657. The retention force between plug and socket can be significantly improved by the clamping device. At the same time, plug pins of different sizes can also be held with high axial tensile strength.

A drawback presenting itself is, however, that the plug pin can be contacted when plug and socket are not intermated, or not fully so, and as a result for example an electrostatic charging by the contacting person can lead to an undesired current flow. This is highly detrimental, particularly if and when the lead issuing from the connector belongs to an electromedical device and is conducted, for instance, to a patient's heart. Therefore the electrical connector according to German Utility Model No. 1 738 657 is not suited for such use.

To be sure, it is already also known to provide connectors protected against accidental contact, however, with these the plug is then insufficiently secured against inadvertent withdrawal, which would be especially disadvantageous in case of use on an electomedical device.

In various fields of technology and particularly in medical technology, to which mention was already made, it is often necessary to have leads and particularly electrical connectors which are protected against accidental contact, but are also adequately protected against inadvertent disconnection.

SUMMARY OF THE INVENTION

The object underlying the invention is therefore to provide an electrical connector of the type set forth at the outset, preserving the advantages of a clamping device in the socket and nevertheless permitting accidental-contact protection of the plug pin, although the plug pin is to be inserted into the clamping device and clip thereof and it is then to be possible to close the latter by the screw movement.

To accomplish this object, the electrical connector mentioned at the outset is characterized in that the plug has a rotatably mounted sleeve which surrounds the plug pin externally and in spaced relationship to it and is of an axial length and internal dimensions adapted to the conical section of the clamping device, whereby in the assembled condition said sleeve is axially movably pushed onto the conical section and at the same time is form-lockingly coupled to the conical section in the direction of rotation.

By virtue of this sleeve, the plug pin is hence shielded at least laterally, thus even if the plug is withdrawn from the socket the pin cannot be inadvertently contacted when taking hold of the plug. Nevertheless, after the plug pin has been inserted into the clip, it is possible to rotate the conical section, although strictly speaking this is prevented by the sleeve. This contradiction is eliminated according to the invention in that the sleeve is rotatable and is directly or indirectly coupled to the conical section in the direction of rotation, so that the sleeve can be rotated for rotating the conical section and for closing the clip. Since, however, the sleeve itself remains axially movable in relation to the conical section, the axial movement relative to the sleeve brought about by rotating the conical section can take place unproblematically. As this is taking place, the plug pin itself retains its inserted position unchanged and, by turning the sleeve rotatable relative thereto, is clamped by the clip. Consequently the sleeve has a dual function by protecting the plug pin against accidental contact and simultaneously, through its rotation, serving to close the clip of the clamping device.

It is particularly suitable if the rotatable sleeve is captivated on the plug. Hence a rotary coupling between sleeve and plug is suitable which is nondetachable or is not readily detachable. Neither can the original accidental-contact protection be inadvertently removed. Consequently, also in the coupled condition, that is when plug and socket are assembled, this sleeve cannot be removed and it then still retains its function as accidental-contact protection in this position.

It is especially advantageous if the rotatable sleeve is longer in the axial direction than the pin of the plug and projects beyond the pin in the axial direction. By this means the accidental-contact protection is enhanced as compared with an arrangement in which sleeve and plug pin end at about the same level.

Further improved accidental-contact protection, also when the connector is in a detached condition, can be achieved by the rotatable sleeve projecting beyond the plug pin so far that the plug pin is unreachable for a finger. This can be promoted by also selecting the diameter of the open free end of the sleeve to be appropriately small.

The compressible parts of the clip, and the pin, are made of metal and the conical section exhibiting the cone for compressing the clip can insulate the clip at least externally, in particular can be made of plastic. Consequently the socket is also protected against accidental contact to a very large extent, but nevertheless permits good contacting within the plug arrangement.

The conical section can have—on a suitable sleeve or the like—an internal thread fitting on an external thread of the clip, and the inner cone of the conical section and the outer cone of the clip can be arranged axially adjacent to the threaded area; this threaded part can be externally coated with the insulation, particularly of plastic, whereby this plastic coating can be of sleeve-like configuration and at the end opposite the insertion end can project axially beyond the threaded area by at least the distance taken for unscrewing the fitting. Therefore accidental-contact protection is preserved even when the clip is open, when possibly the plug pin is still inserted in it. Hence, also when the connector is assembled, it is prevented that accidental contact be made with metallic, electroconductive parts connected to the electrical lead to e.g. the heart.

The insulation of the conical section can overlie and cover its front face, further enhancing the accidental-contact protection. It is true that this front face is situated inside the sleeve during insertion of the plug pin or also during withdrawal, however it cannot be ruled out that the plug is connected to a lead conducted to a sensitive part or organ, so that there as well the contact and transfer for instance of an electrostatic charge is to be prevented.

Further improvement, particularly in the accidental-contact protection, can be achieved by the rotatable sleeve being made of or covered by insulating material, particularly plastic. Therefore, even in adverse conditions, no electric current or voltage can reach the plug pin or—when the connector is assembled—the socket and its electric contacts, hence the clip.

The rotatable sleeve can be externally profiled, for instance knurled or roughened. This renders it simpler to rotate for closing the clip and higher torque can be transferred, hence clamping force of commensurate magnitude can be attained, even if the outer diameter of the sleeve—also for improving the accidental-contact protection from its front face—is selected to be relatively small.

A simple solution in structural terms is obtained if the rotatable sleeve is slipped onto a connecting piece of the plug—through which the plug pin emerges—and is fixed in the axial direction by a snap connection or by an element engaging simultaneously with the connecting piece and with the sleeve. A snap connection has the advantage of permitting very simple assembly. A locking element for axial fixation, engaging simultaneously with the connecting piece and with the sleeve, permits that the sleeve be disassembled and replaced if necessary, should the sleeve become damaged in use with the result that it might no longer be capable of performing its functions, particularly the accidental-contact protection.

The connecting piece, which belongs to the plug and rotatably mounts the rotatable sleeve, can have an annular groove and a cross pin can be arranged tangentially to this groove or base thereof, the cross section of said pin in any case engaging with the groove. In addition, the cross pin traverses the rotatable sleeve transversely of the centre axis of the sleeve and eccentrically thereto. Therefore the sleeve can be rotated together with the cross pin, because the latter can then be moved in and at the periphery of the annular groove, while being in engagement therewith. In case of need, however, this cross pin can be pushed in its longitudinal direction back out of a corresponding bore in the sleeve or—if it is a threaded pin—can be unscrewed. Furthermore, a rotary coupling establishing axial fixation between sleeve and plug is naturally also possible with the aid of spring rings or the like.

To be sure, the rotatable sleeve could have an inside profiling which is circular in cross section and co-operates frictionally with the screwable conical section. However, it is especially suitable if the inside profiling of the rotatable sleeve and the outside profiling of the rotatable conical section, or more specifically its insulation, are in each case a tallying polygon. Therefore the rotary movement at the sleeve can be transferred through a form fit to the conical section which then can nevertheless perform the axial movement relative to the sleeve, as ensues during the screw action. At the same time, slipping the sleeve onto this conical section becomes considerably simpler than if an inwardly directed projection inside the sleeve would have to be inserted into a corresponding external groove of the conical section—or vice versa.

Particularly when the above-described features and measures are combined singly or severally, a clip connector protected against accidental contact ensues, including a clip and a specially shaped screw-on cap, or more specifically a specially shaped screwable conical section, with which adequate protection against accidental contact from the top and from the sides is ensured and which is also shaped in such a way as to be able to enter into a mechanical form fit with the specially configured plug in the direction of rotation, so as to be capable of being screwed with the plug, or more specifically with the appertaining sleeve, but simultaneously permitting the relative axial movement necessary for this purpose. This sleeve serving for screw action is captive and for its part extends beyond the plug pin so far as to likewise constitute accidental-contact protection. Both in the detached and in the assembled position, the accidental-contact protection necessary in many instances when the connector is detached is achieved. Nevertheless, the advantage of a clip with correspondingly good contacting and, above all, firm coupling in the axial direction, as well as adaptation to plug pins varying in thickness is attained.

BRIEF DESCRIPTION OF THE DRAWINGS

An exemplary embodiment of the invention will be described in greater detail below with reference to the drawings in which, in schematized form.

DETAILED DESCRIPTION OF THE INVENTION

Figure 1:
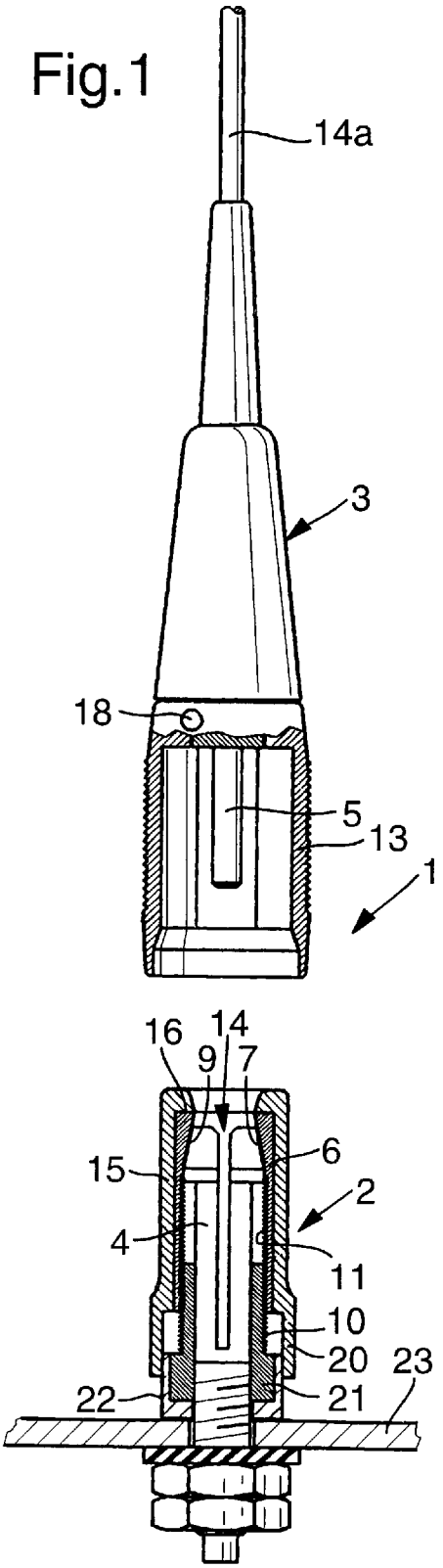
FIG. 1 depicts, partly in longitudinal section, a connector in the withdrawn position, in which a socket with a clip is fixed to a housing wall and has a connection to a power source, while the complementary plug presenting a pin is arranged on a lead to a current consumer, for instance to a patient's heart.
Figure 2:
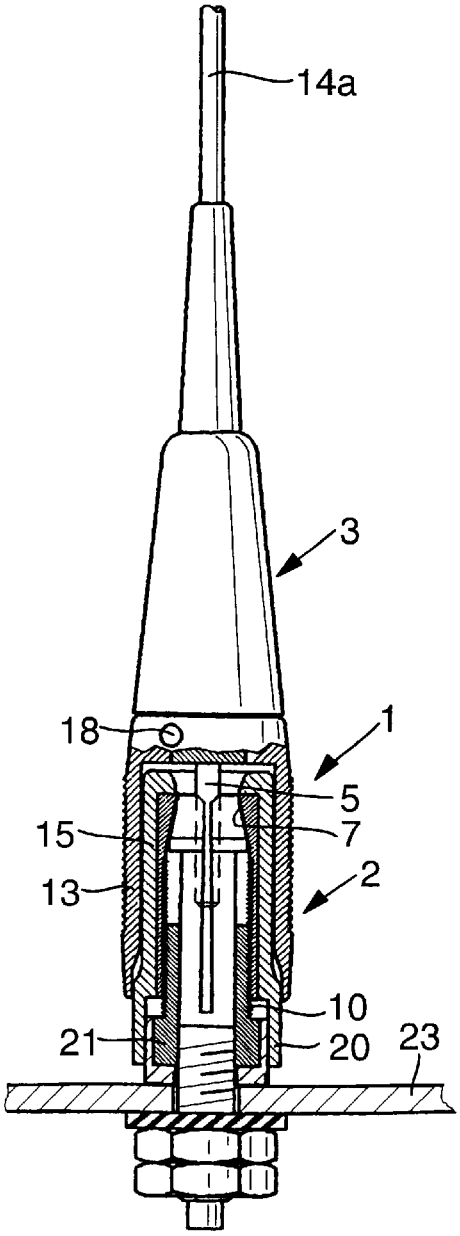
FIG. 2 is the connector of FIG. 1 after assembly and after the pin has been clamped in the clip, on an enlarged scale
Figure 3:
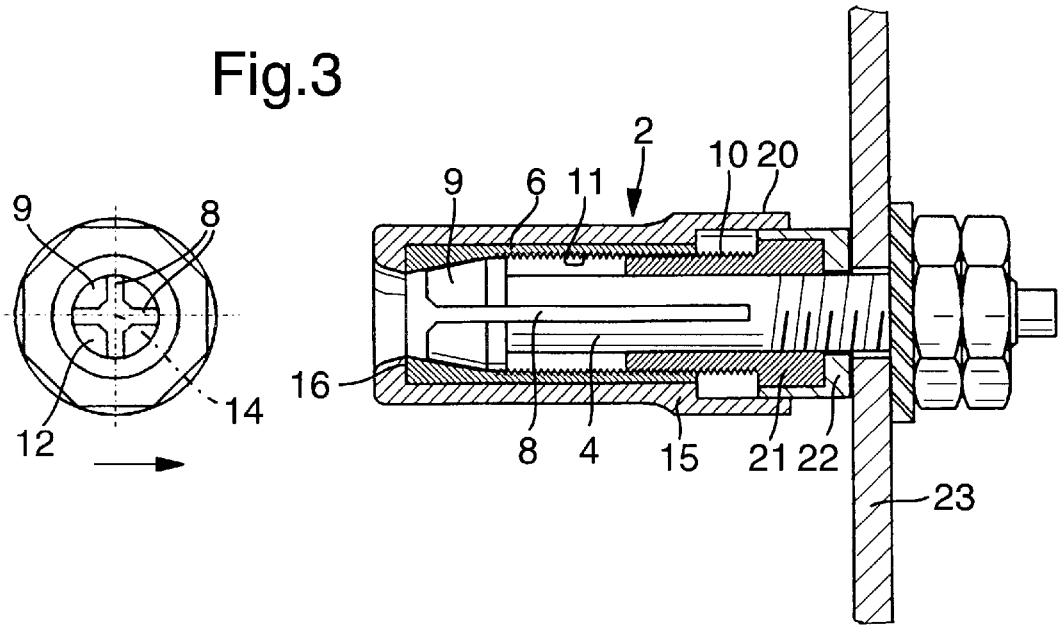
FIG. 3 is a longitudinal section through the socket with its front view seen in the direction of the arrow in the same Figure.
Figure 4:
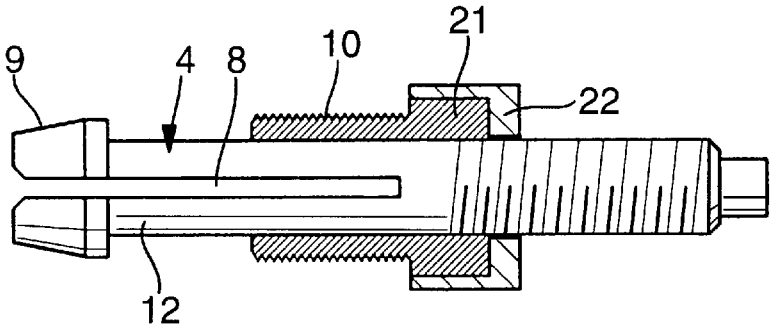
FIG. 4 is a longitudinal section through the clip of the socket with the clamping jaws, a slot therebetween and the conical ends of this clip as well as an external thread.

An electrical connector, generally designated 1, has in the customary fashion a plug 3 and a socket 2 whereby, according to FIG. 1 and particularly according to FIGS. 3 and 4, the socket 2 contains a clip 4 or a similar clamping device into which a pin 5—the single pin 5—of the plug 3 is insertable. By means of a screw movement of a conical section 6, which according to FIG. 5 has an inner cone 7, the clip 4 provided with axial slots 8 can be compressed in the customary fashion, the clip having at its free ends a complementary cone 9 to the inner cone 7. It is evident that by screwing the conical section 6 to the right so as to depart from the position depicted in FIG. 3, the axial slots 8 and thereby the clip 4 is compressed, because the inner cone 7 compresses the complementary cone 9 accordingly. If then according to FIG. 2 the plug pin 5 is situated in the clip 4, it is fixed with correspondingly good clamping force, avoiding unintentional detachment of the connection as a whole.

FIGS. 3 and 4 show an external thread 10 on the clip 4 and fitting on it an internal thread 11 on the conical section 6, adjacent to the inner cone 7. As a consequence, the already mentioned compression of the clip 4 by a screw movement of the conical section 6 is enabled, so that the previously inserted pin 5 of the plug 3 is fixed and located in position in the clip 4 of the socket 2. The thread can be tightened so firmly so as practically preclude unintentional withdrawal of the plug pin 5. The front view according to FIG. 3 shows that the clip 4 has four clamping elements or clamping fingers 12 and accordingly also four axial slots 8.

Figure 6:
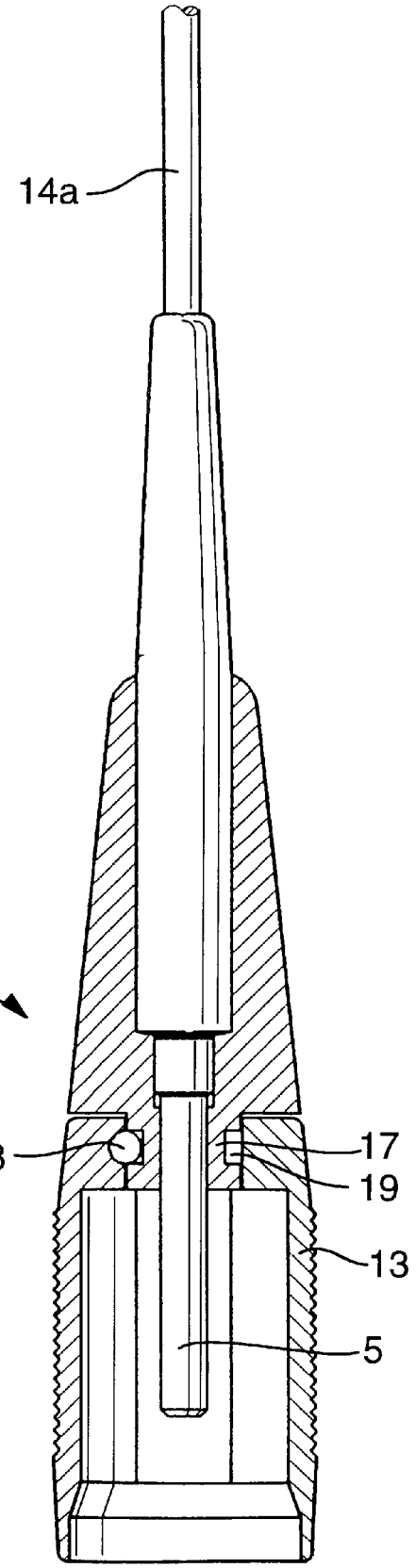
FIG. 6 is a longitudinal section through the plug, shown on a larger scale than in FIGS. 1 and 2, with the rotary mount of a sleeve which serves as accidental-contact protection for the plug pin and also axially projects beyond the latter.

Particularly in FIG. 6, but also in FIG. 1 one can see that the plug 3 carries a rotatably mounted, generally cup-shaped sleeve 13 surrounding the plug pin 5 externally and in spaced relationship to it. Further, one can see that the sleeve 13 is of such an axial length and internal dimensions that according to FIG. 2, when the plug pin 5 is inserted into the clip 4, the sleeve 13 is axially movably pushed in an axial direction onto the component serving to rotate the conical section 6 of the clip 4 and at the same time is coupled thereto in the direction of rotation.

Therefore it is possible to insert the plug pin 5 into the central opening 14 of the clip 4, between the clamping fingers 12 of the clip 4, and thereby at the same time to push the sleeve 13 onto the outside of the conical section 6 and to couple it to this conical section 6 in the direction of rotation. As a result, despite the sleeve 13 making the plug pin 5 inaccessible from the side, the screw movement at the clip 4 can be carried out by now rotating the sleeve 13. The sleeve 13 then drives the conical section 6 so that the latter is screwed further and further onto the external thread 10, such bringing about the desired compression of the clamping fingers 12 of the clip 4 and thereby the fixation of the plug pin 5.

FIG. 6 illustrates that the sleeve 13 protects the plug pin 5 against accidental contact, particularly from the side. This protection is also preserved in the closed position of the connector 1 according to FIG. 2, because the rotatable sleeve 13 is captivated on the plug section 3, as will be explained below.

FIGS. 1 and 6 also illustrate that the rotatable sleeve 13 is longer in the axial direction than the plug pin 5 and projects axially beyond it. Accidental contact of the plug pin 5 is therefore impeded further. The sleeve 13 can project beyond the plug pin 5 so far that the plug pin 5 is unreachable for a finger. Thus good protection against accidental contact ensues even when the plug 3 is detached, this being of great significance and advantage if and when, for instance, the lead 14*a* presenting the plug 3 is conducted to a patient's heart. Namely, it is ruled out that electrostatic charging by the user of the plug 3 can— inadvertently—send its charge via the plug pin 5 and lead 14*a* to such a patient.

The compressible components of the clip 4, that is its clamping fingers 12, and the plug pin 5 are made of metal, for example brass, for good contacting. The conical section 6 exhibiting the inner cone 7 for compressing the clip 4 is configured in such a way as to externally insulate the clip 4. By way of example, the conical section 6 could be made of plastic, however according to FIG. 5 it is proposed that it is provided with a sleeve-like plastic coat 15. Therefore the area of the inner cone 7 and internal thread 11 is externally coated with the plastic insulation, whereby according to FIGS. 1 to 3 and 5 at the end opposite the insertion end this plastic coat 15 projects axially beyond the thread area by at least the distance taken for unscrewing the fitting. It is apparent that the plastic coat 15 still engages over the area of the thread 10 even in the open condition (FIG. 1), so that lateral access to the thread 10 is also prevented in this position. Since the area adjoining this thread 10 is again insulated by a plastic coat, the entire socket 2 is externally insulated and has accidental-contact protection, so that there as well the contact by a person does not lead to undesired transfer of current or voltage, as would be adverse particularly if and when the plug pin 5 is in the position of use.

Figure 5:
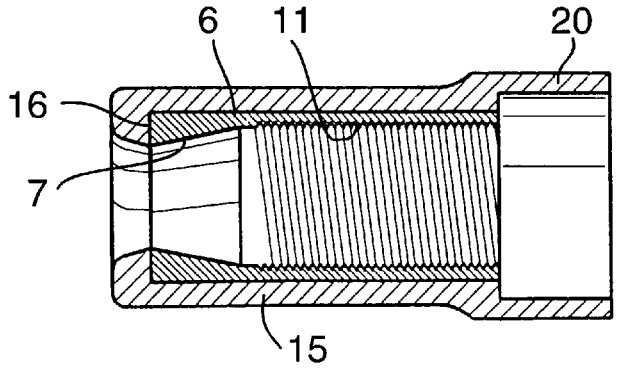
FIG. 5 is a longitudinal section through a conical section having an inner cone complementary to the front conical ends of the clip, whereby adjacent to this inner cone is an internal thread which fits on the external thread of the threaded body of the clip and, when this conical section is screwed home, results in an axial movement and thus to compression of the clip.

According to FIG. 5, the insulation 15 of the conical section 6 also overlies its front face 16, so that even under adverse conditions a contact of electroconductive parts of the connector 1 appears impossible.

The rotatable sleeve 13 of the plug 3 can for its part be made of or coated by insulating material, plastic for example. However, this is not absolutely necessary if, as described, the conical section 6 and also the other parts of the plug-in component are insulated toward the outside or have an insulating coat 15.

In FIG. 6 it is indicated that the rotatable sleeve 13 can be externally profiled, for example knurled or roughened. Since the clamping force for fixing the plug pin 5 in the clip 4 is to be generated at this sleeve 13 by rotating it, such a configuration is an aid. Clamping forces of suitable magnitude can be generated even if the outer circumference or diameter of the sleeve 13—for improvement of the accidental-contact protection from its open end—is selected to be relatively small.

According to FIG. 6, the rotatable sleeve 13 is slipped or pushed onto a connecting piece 17 of the plug 3 and can be captivated there by a snap connection. In the exemplary embodiment, however, the sleeve 13 is axially fixed by an element, namely a cross pin 18, simultaneously engaging with the connecting piece 17 and the sleeve 13. This is realized by the connecting piece 17 which belongs to the plug 3 and rotatably mounts the rotatable sleeve 13 having an annular groove 19 and by the cross pin 18 being arranged approximately tangentially to the annular groove 19 or base thereof, and having its cross section partly in engagement therewith, in the exemplary embodiment by about half, and by the cross pin also traversing the rotatable sleeve 13 crosswise of its centre axis and eccentrically thereto. By reference to FIG. 6 it is apparent that this permits a rotation of the sleeve 13, the sleeve 13 then being rotated together with the cross pin 18 because the cross pin 18 can move along the annular groove 19. An axial detaching movement of the sleeve 13 off the connecting piece 17 is however prevented by the cross pin 18 engaging with the annular groove 19.

Figure 7:
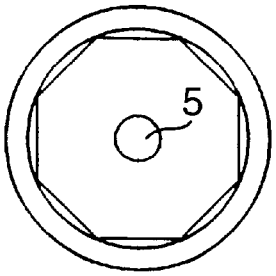
FIG. 7 is the front view of the plug seen from the open end of the rotatable sleeve, showing the octagonal inside profiling of the sleeve corresponding in shape and size to the octagonal outside profiling of the screwable conical section according to FIG. 3, hence belonging to coupling effective in the direction of rotation between sleeve and conical section.

In regarding the front view of the conical section 6 with its coat 15 in FIG. 3 together with the sleeve 13 from its open side in FIG. 7, it becomes clear that the inside profiling of the rotatable sleeve 13 and the outside profiling of the rotatable conical section 6 or more specifically the coat 15 thereof correspond in each case to a polygon, whereby in the exemplary embodiment an octagon is provided. Such permits easy assembly without complicated interassociation of parts and nevertheless in the direction of rotation produces a firm, but detachable coupling, which also permits the necessary relative movement between sleeve 13 and conical section 6 during the screw action.

At the same time, the projecting length 20 of the coat 15 departs from the detached position depicted in FIG. 1 and 3 and is pushed further over a base 21 of the external thread 10. In order that also in the open position accidental contact of the metallic thread 10 or its base 21 is prevented there, this area or base 21—not shielded by the conical section 6, or more specifically by its insulating coat 15 when the clip is in the open position with inserted plug pin 5—is likewise externally insulated by a generally cup-shaped insulating body 22. The latter also provides insulation with respect to a housing wall 23 to which the socket 2 is attached in this exemplary embodiment.

We claim:

1. An electrical connector (1) with a plug (3) and a socket (2), whereby the socket (2) has a clamping device for fixing a pin (5) of the plug (3), the clamping device consisting of a clip (4) and a conical section (6) form-lockingly interconnected by means of a threaded joint and the fixation of the plug pin (5) in the clamping device being constituted by the relative movement of clip (4) and conical section (6) to each other by means of the threaded joint, characterized in that the plug (3) has a rotatably mounted sleeve (13) which surrounds the plug pin (5) externally and in spaced relationship to it and is of an axial length and internal dimensions adapted to the conical section (6) of the clamping device, whereby in the assembled condition said sleeve (13) is axially movably pushed onto the conical section (6) and at the same time is form-lockingly coupled to the conical section (6) in the direction of rotation.

2. An electrical connector as claimed in claim 1, characterized in that the rotatable sleeve (13) is captivated on the plug (3).

3. An electrical connector as claimed in claim 1, characterized in that the rotatable sleeve (13) is longer in the axial direction than the pin (5) of the plug (3) and projects beyond said pin in the axial direction.

4. An electrical connector as claim 1, characterized in that the sleeve (13) projects axially beyond the plug pin (5) so far that the plug pin (5) is unreachable for a person's finger.

5. An electrical connector as claim 1, characterized in that the compressible parts of the clip (4), and the pin (5), are made of metal and that the conical section (6) exhibiting an inner cone (7) for compressing the clip (4) externally insulates the clip (4), in particular is made of plastic.

6. An electrical connector as claim 1, characterized in that the conical section (6) has an internal thread (11) fitting on an external thread (10) of the clip (4), and that the inner cone (7) of the conical section (6) and a complementary cone of the clip (4) are arranged axially adjacent to the threaded area, and that said threaded part is externally coated with the insulation, particularly of plastic, whereby said plastic coating (15) is of sleeve-like configuration and at the end opposite the insertion end projects axially beyond the threaded area by at least the distance taken for unscrewing the fitting.

7. An electrical connector as claim 1, characterized in that the insulation of the conical section (6) overlies and cover its front face (16).

8. An electrical connector as claim 1, characterized in that the rotatable sleeve (13) is made of or covered by insulating material, particularly plastic.

9. An electrical connector as claim 1, characterized in that the rotatable sleeve (13) is externally profiled, for instance knurled or roughened.

10. An electrical connector as claim 1, characterized in that the rotatable sleeve (13) is slipped onto a connecting piece (17) of the plug (3) and is fixed in the axial direction by a snap connection or by an element engaging simultaneously with the connecting piece (17) and with the sleeve (13).

11. An electrical connector as claim 1, characterized in that a connecting piece (17), which belongs to the plug (3) and rotatably mounts the rotatable sleeve (13), has an annular groove (19) and that a cross pin (18) is arranged tangentially to said groove (19) or base thereof, the cross section of said pin partly engaging with the groove (19), which cross pin additionally traverses the rotatable sleeve (13) transversely of the centre axis of the sleeve and eccentrically thereto.

12. An electrical connector as claim 1, characterized in that the inside profiling of the rotatable sleeve (13) and the outside profiling of the rotatable conical section (6) correspond to a polygon.

13. An electrical connector as claimed in claim 1, characterized in that the external thread (10) has a base (21) which, when the clip (4) is in the open position with the plug pin (5) inserted therein, is shielded by an insulating body (22).

* * * * *